United States Patent [19]

Feliks et al.

[11] Patent Number: 4,569,185

[45] Date of Patent: Feb. 11, 1986

[54] SELF-ADJUSTING PACKAGING MACHINE

[75] Inventors: James J. Feliks, Doraville; Will L. Culpepper, Tucker, both of Ga.

[73] Assignee: The Mead Corporation, Atlanta, Ga.

[21] Appl. No.: 555,922

[22] Filed: Nov. 29, 1983

[51] Int. Cl.[4] ..... B65B 11/08

[52] U.S. Cl. ..... 53/580; 53/209; 53/297; 198/425

[58] Field of Search ..... 53/209, 297, 327, 397, 53/478, 580; 198/425, 460, 461

[56] References Cited

U.S. PATENT DOCUMENTS

| | | | |
|---|---|---|---|
| 3,236,162 | 2/1966 | Reist | 198/425 |
| 3,890,763 | 6/1975 | Ullman | 52/580 |
| 4,201,286 | 5/1980 | Meier | 198/461 |
| 4,365,456 | 12/1982 | Ullman | 53/580 |
| 4,475,653 | 10/1984 | Ullman | 53/329 |

*Primary Examiner*—John Sipos
*Assistant Examiner*—Donald R. Studebaker
*Attorney, Agent, or Firm*—B. J. Powell

[57] ABSTRACT

A packaging machine for applying a film over the articles in an open top tray and bonding the film to the tray side walls. A plurality of unconnected flight bars are mounted for free movement around an endless path. Each tray and film is captivated between adjacent flight bars as they move along a compression portion of the endless path. A feed conveyor individually feeds the flight bars into one end of the compression portion of the endless path to captivate the trays and to push the released flight bars along the compressive portion of the endless path through the captivated trays so that different size trays are automatically accommodated. The flight bars are returned to the feed conveyor by a lift conveyor and a metering conveyor.

16 Claims, 7 Drawing Figures

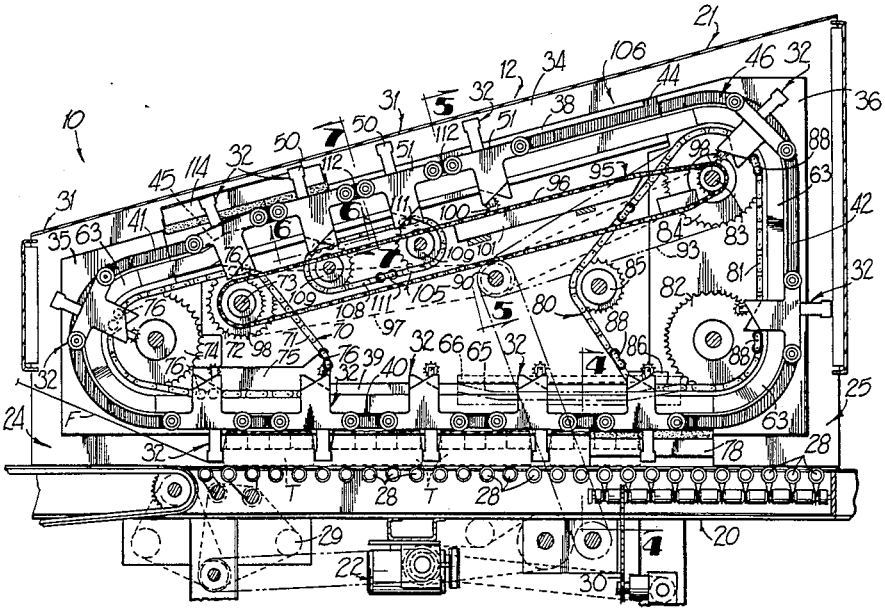

SELF-ADJUSTING PACKAGING MACHINE

BACKGROUND OF THE INVENTION

This invention relates generally to the packaging of articles such as cans, bottles, and the like in paperboard trays and more particularly to a packaging machine for applying a sheet of film over the articles in the tray and bonding the film to the tray side walls to hold the articles in the tray.

Machines which package articles in open top paperboard trays by applying a sheet of film over the articles and bonding the film to the tray side walls are known in the prior art. While the film may be adhesively bonded to the tray side walls with these machines, a thermoplastic film is typically used which will bond to the tray side walls when the film is heated and pressed thereagainst. Also, the film used is typically heat shrinkable and the thusly formed package is subsequently heated to shrink the film and tightly lock the articles in the tray.

In these prior art machines, open top paperboard trays loaded with the articles to be packaged are moved along a prescribed path. As the trays are conveyed along the path, a sheet of thermoplastic film is dispersed over the articles in the tray and wrapped over the articles by a plurality of flight bars moving along an endless path. The tray with the articles therein is captivated between adjacent flight bars as the flight bars move along a portion of the endless path so that the flight bars force the film down between adjacent trays and press the film against the tray side walls. After the film is bonded to the tray side walls, the film between trays is severed to separate the packages from each other. Where the film is bonded to the trays using heat, the flight bars mount heating units thereon that press the film against the opposite sides of the tray and heat the film sufficiently to cause the film to adhere well to the tray.

U.S. Pat. No. 3,890,763 illustrates one type of machine for performing this packaging operation. In that machine, the flight bars are mounted at spaced apart positions between a pair of endless chains so that the chains move the flight bars around an endless path with a fixed spacing between the flight bars. This type machine is able to operate at relatively high speeds, however, the fixed spacing between the flight bars limits the machine to the handling of one size tray. Thus, in packaging operations using different size trays, this type machine has not been practical.

Another type machine is illustrated in U.S. Pat. No. 4,365,456 in which alternate flight bars are mounted between a first set of conveyor chains while the other flight bars are mounted between a second pair of conveyor chains where both the first and second sets of conveyor chains move along the same endless path. Since the first and second sets of conveyor chains can move relative to each other, the spacing between each set of adjacent flight bars can be varied. This allows the machine to accept different size trays for packaging. However, only one tray can be placed in compression at one time. This has limited the overall speed of the machine, especially where the film is welded to the tray side walls.

SUMMARY OF THE INVENTION

These and other problems and disadvantages associated with the prior art are overcome by the invention disclosed herein by providing a packaging machine which has the capability of applying a film to different size trays while at the same time being able to place multiple trays under compression at the same time. As a result, the production speed of the machine is increased over that associated with the prior art. Moreover, the machine incorporating the invention has the capability of accepting different sizes trays within a prescribed size range without any machine adjustment as is required with the prior art machines.

The machines incorporating the invention includes a plurality of flight bars which are movably mounted between a set of tracks for movement along an endless path. The flight bars are not connected directly to each other so that each flight bar can move relative to the flight bars adjacent thereto as they move around the endless path. A feed conveyor is provided at the infeed end of the machine to sequentially feed the flight bars in between adjacent trays while at the same time wrapping the film over the articles in the tray. The feed conveyor serves to push all of the flight bars in the lower flight of the endless path together with the trays captivated therebetween toward the discharge end of the machine. A lift conveyor at the discharge end of the machine individually removes the flight bars from the discharge end of the lower flight of the endless path and moves the flight bars up to an accumulating position so that gravity moves the flight bars back toward the infeed end of the machine. To individually feed the flight bars onto the feed conveyor in synchronization with the feed conveyor, a metering conveyor is provided which individually meters the flight bars from the accumulated position to the feed conveyor.

These and other features and advantages of the invention disclosed herein will become more apparent upon consideration of the following detailed description and accompanying drawings wherein like characters of reference designate corresponding parts throughout the several views and in which:

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Figures 1, 3:
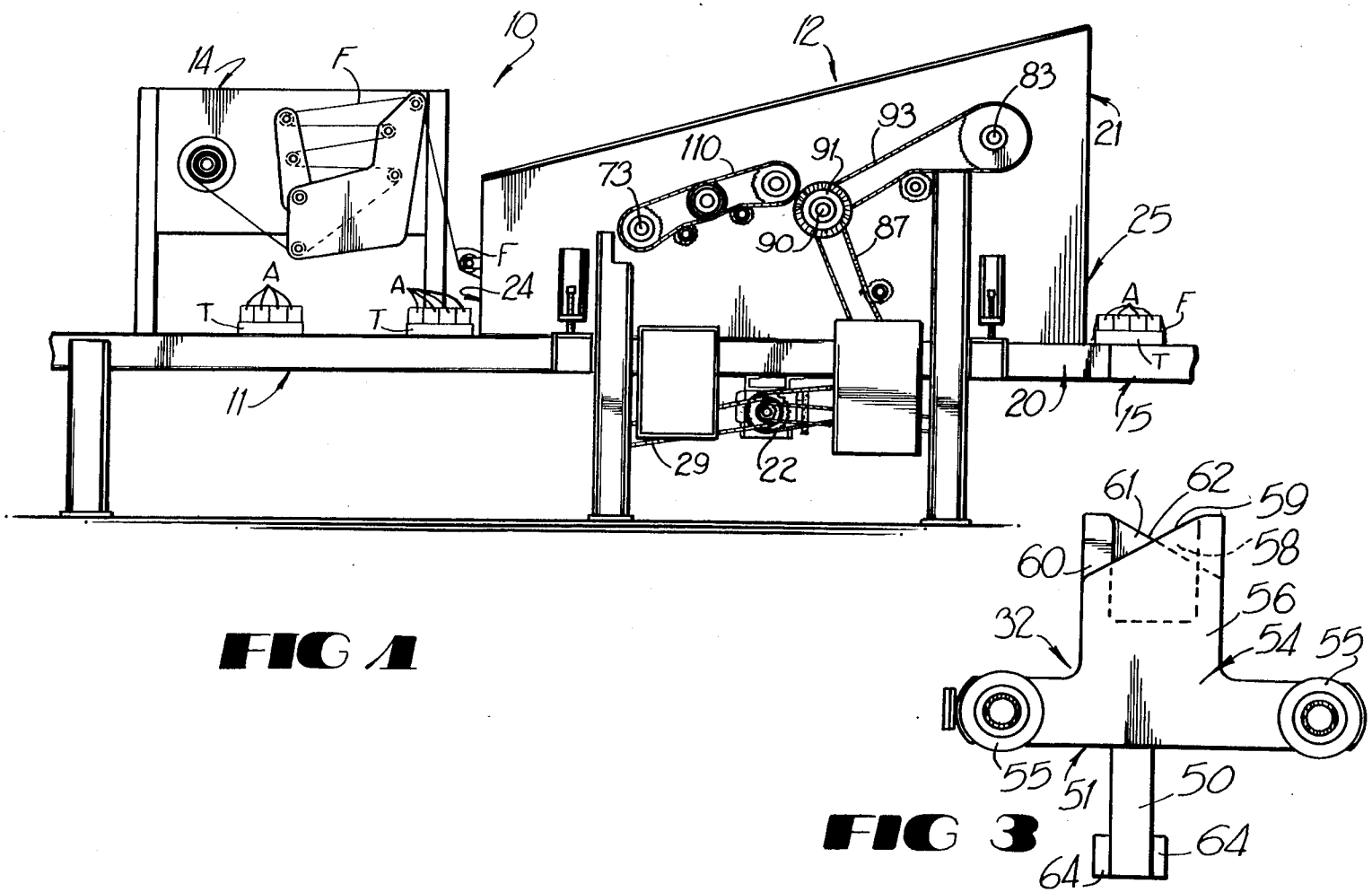
FIG. 1 is a side view of a packaging machine embodying the invention.
FIG. 3 is an enlarged end view of one of the flight bar units.
Figure 2:
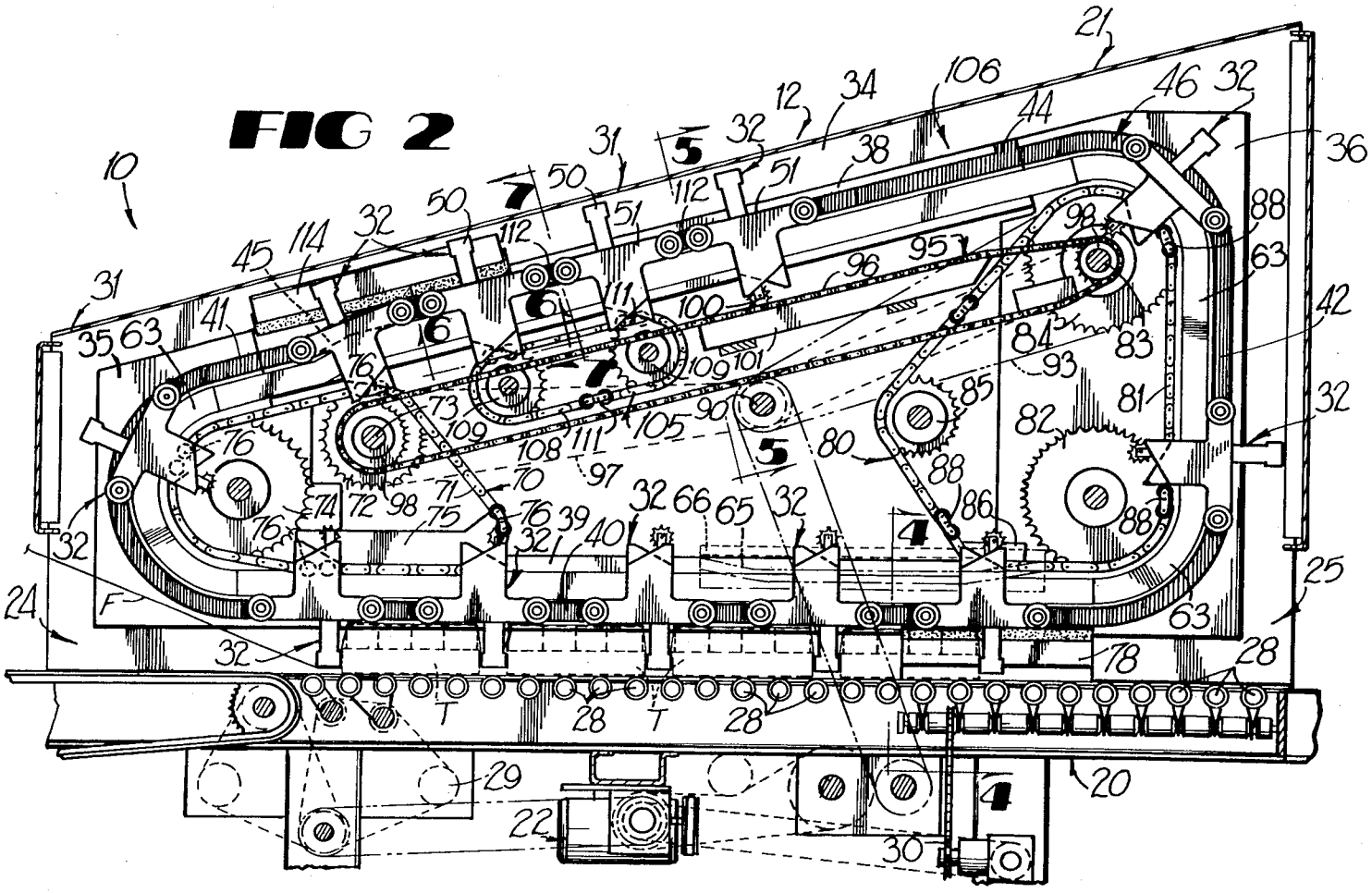
FIG. 2 is a longitudinal cross-sectional view thereof.

Referring to FIGS. 1 and 2, it will be seen that the invention is incorporated in a packaging system 10 which applies a film over the tops of articles such as cans, bottles and the like carried in an open top corrugated paperboard tray, bonds the film to opposite side walls of the tray and then cuts the film between the trays to separate the packages. While the packaging system 10 may adhesively bond the film to the tray, a thermoplastic film is typically used which is welded directly to the tray side walls by heat and pressure applied by the system 10.

The packaging system 10 as seen in FIG. 1 includes an infeed conveyor 11 to supply trays T loaded with articles A to a compression and welding machine 12. As the loaded tray T moves into the compression and welding machine 12, a continuous film F dispensed from a constant tension unwinder 14 is applied over the articles A in the tray T. The compression and welding machine 12 wraps the film tautly over the articles in tray T and presses the film against opposite side walls of the tray while heating the film. This causes the heated sections of the film to bond or weld directly to the tray side walls. After the film has been welded to the trays, the film is cut between trays to separate the film covered trays from each other. The separated trays are discharged onto an outfeed conveyor 15. Typically, the film used is also heat shrinkable and the film covered trays are moved through a heat tunnel (not shown) to heat shrink the film over the articles and form a tight package.

The compression and welding machine 12 includes generally a conveyor section 20 which receives the loaded trays T from the infeed conveyor 11 and supports the trays while the film F is being applied thereover. The machine 12 also includes a flight bar section 21 positioned above the conveyor section 20 which wraps the film over the articles in the trays and welds the film to the side walls of the trays while the trays are supported on the conveyor section 20. A drive unit 22 is provided for driving both the conveyor section 20 and the flight bar section 21. For simplicity, the infeed end of the compression and welding machine 12 will be designated 24 and the discharge end will be designated 25.

The conveyor section 20 includes a plurality of support rollers 28 rotatably mounted about horizontal axes normal to the path of movement of the trays T through the machine so that the trays T will be supported on the tops of the rollers 28 as they are moved through the machine 12. Those support rollers 28 immediately adjacent the infeed end 24 of the machine 12 are positively driven by the drive unit 22 through an appropriate chain and sprocket arrangement 29 as best seen in FIG. 2. This insures that the tray T will be positively fed into the machine 12 to the compression and welding position as will become more apparent. Those support rollers 28 adjacent the discharge end 25 of the machine 12 are also positively driven as best seen in FIG. 2. These rollers 28 are also driven from the drive unit 22 through a chain and sprocket arrangement 30. These rollers 28 at the discharge end of the machine 12 serve to positively drive the tray T out of the machine 12 after the film has been welded to the side walls of the tray to clear the machine. The rollers 28 between these sets of driven rollers are freely rotatable so that the trays can be easily pushed thereover.

The flight bar section 21 as best seen in FIGS. 2–7 includes a pair of spaced apart side frames 31 which movably mount therebetween a plurality of flight bar units 32 for movement of the flight bar units 32 around an endless path. The endless path along which the flight bar units move is greater than the cumulative length of the flight bar units 20 and the flight bar units 32 are not connected to each other so that each flight bar unit 32 can move relative to the adjacent flight bar units 32 as will become more apparent. The endless path along which the flight bar units 32 move has a lower flight along which the flight bar units 32 move while captivating the trays T and the film F therebetween for the film F to be pressed against the side walls of the trays and bonded thereto. The endless path also includes a riser section at the discharge end of the machine up which the flight bar units 32 are moved to a downwardly inclined return flight back toward the infeed end of the machine 12.

Each of the side frames 31 includes a generally vertically oriented side plate 34 which mounts thereon a feed track plate 35 adjacent the infeed end of the machine and a riser track plate 36 thereon adjacent the discharge end of the machine. A return track 38 is mounted on the side plate 34 and extends between the top of the riser track plate 36 and the top of the feed plate 35 at a downwardly inclined angle. A compression track 39 connects the bottom of the riser track plate 36 with the bottom of the feed plate 35. The plates 35 and 36 together with the tracks 38 and 39 define an endless inwardly opening slot 46 therein. The compression track 39 defines a rectilinear compression slot segment 40 therein which is aligned with the lower end of the feed slot segment 41 in the feed track plate 35 and with the lower end of the riser slot segment 42 in the riser track plate 36. The riser slot segment 42 curves upwardly above the level of the compression slot segment 40 through a generally vertical riser section and then curves back over itself to be aligned with return slot segment 44 in the return track 38. The return slot segment 44 angles downwardly toward the entry end of the machine at a prescribed angle illustrated at about 15°. Adjacent the feed track plate 35, the return slot segment 44 has a downwardly directed offset 45 therein with the end of the slot segment 44 at the return track plate 35 aligned with the upper end of the curved feet slot segment 41 in the feed track plate 35. Thus, the continuous slots 46 in the opposed side frames 31 are aligned with each other across the path of movement of the trays T. The slot 46 thus defines the endless path along which the flight bar units 32 are moved.

Each flight bar unit 32 includes a flight bar 50 oriented normal to the path of movement of the tray T through the machine 12. Each flight bar 50 has a pair of mounting assemblies 51 connected to opposite ends thereof to movably mount the flight bar unit 32 between the endless slots 46 in the side frames 31.

Each mounting assembly 51 includes a generally vertically oriented mounting plate 54 attached to the end of the flight bar 50 and oriented generally normal to the axis of the flight bar 50. The mounting plate 54 has leading and trailing legs thereon which rotatably mount mounting rollers 55 thereon oriented for rotation about axes generally parallel to the axis of the flight bar 50. The mounting rollers 55 are sized to be rotatably supported in one of the endless slots 46 so that the mounting rollers 55 in the mounting assemblies 51 at the opposite ends of the flight bar 50 serve to movably mount the flight bar units 32 between the endless slots 46 in the side frames 31. The mounting rollers 55 on each mounting plate 54 are aligned along a path normal to the flight bar 50 so that the flight bar 50 will be oriented perpendicular to the slots 46 as will become more apparent.

Each mounting plate 54 also includes a drive portion 56 thereon which projects away from the path on which the mounting rollers 55 are mounted and defines an inwardly opening recess 58 therein which opens onto the projecting end 59 of the drive portion 56. It will be appreciated that the projecting end 59 of the drive portion 56 is cut at an angle to facilitate engagement of the drive portion 56 of the recess 58 as will become more apparent.

The mounting assembly 51 also includes a drive plate 60 positioned inboard of the drive portion 56 on the mounting plate 54 and oriented generally parallel thereto. The drive plate 60 defines an outwardly opening recess 61 therein which also opens onto the projecting end 62 of the drive plate 60. It will also be appreciated that the projecting end 62 of the drive plate 60 is angled in the opposite sense to the projecting end 59 of the mounting plate 54 to facilitate engagement of the recess 61 as will become more apparent.

Each of the flight bars 50 has a construction similar to that illustrated in U.S. Pat. Nos. 3,890,763 and 4,365,456 owned by the assignee of this application. The flight bars 50 are provided with heaters 64 on the leading and trailing edges thereof to heat the film to welding temperature while it is being pressed against the side walls of the tray as will become more apparent. Each flight bar 50 is also provided with a set of cutters (not shown) which are activated by the cutter cams 65 and 66 engaging the cam followers 68 and 69 as described in the above mentioned patent. Power for the heaters 64 is supplied through bus bars 63 seen in FIG. 2.

It will be appreciated that, in order for the trays T to be captivated between adjacent flight bar units 32 the flight bar units 32 must be moved into the lower flight of the endless path with a specified spacing between the flight bar units. To carry out this function, a feed conveyor 70 is provided as best seen in FIG. 2. The feed conveyor 70 includes a pair of spaced apart feed chains 70 on opposite sides of the machine with each feed chain 71 being trained around a drive sprocket 72 on drive shaft 73, an idler sprocket 74 centered on the center of curvature of the feed slot segment 41 in the feed track plate 35 and a keeper 75 located above the compression slot segment 40 in the compression track 39. The feed chains 71 are located so that they are in alignment with the space between the drive portion 56 on the mounting plate 54 and the drive plate 60 on each of the mounting assemblies 51 of the flight bar unit 32 as it passes around the feed slot segment 41 in the endless slot 46 and onto the entry end of the compression slot segment 40.

Each feed chain 71 is provided with a plurality of roller drive lugs 76 which are mounted on the feed chain 71 at spaced apart positions along the length of the chain 71. The roller drive lugs 76 on the feed chains 71 are aligned with each each other across the machine and the spacing between the roller drive lugs 76 is selected to be the maximum tray length to be handled by the machine as will become more apparent. As will also become more apparent, the roller drive lugs 76 are designed to fit into the recesses 58 and 61 in each of the mounting assemblies 51 as the drive lugs 76 pass over the drive sprocket 72 in the vicinity of the offset 45 in the return slot segment 44. This causes the feed chain 71 to engage and positively move the flight bar unit 32 therewith around the feed slot segment 41 and into the entry end of the compression slot segment 40 with the spacing between the flight bar units 32 corresponding to the spacing of the roller drive lugs 76 on the feed chain 71.

The feed conveyor 70 is activated when a tray T loaded with articles moves into position at the infeed end 24 of the machine 12 so that the flight bar unit 32 moving around the feed slot segment 41 moves in behind the tray T while wrapping the film F thereover. At the same time, the feed chain 71 moves the flight bar unit 32 already at the compression slot segment 40 toward the discharge end of the machine until the flight bar unit 32 moving in behind the tray T captivates the tray T on the leading side thereof. The feed chains 71 release the flight bar unit 32 when the flight bar unit 32 which is moved around the feed slot segments 41 has moved in behind the trays T. After the flight bar unit 32 has moved in behind the trays T, an appropriate cam switch (not shown) stops the feed chains 71 until the next tray T moves into position at the infeed end of the machine 12. FIG. 2 shows the position of the flight bar units 32 and the feed chains 71 after the feed conveyor 70 has cycled. It will thus be seen that the feed conveyor 70 releases all of the flight bar units 32 on the lower flight of the endless path (i.e., those flight bar units 32 in the compression slot segments 40 except the trailingmost flight bar unit 32 adjacent the infeed end of the machine.) This allows the flight bar units 32 to be free to move relative to each other so that the flight bar units 32 are held in position relative to each other by the trays themselves. Typically, the entire machine 12 is angled slightly upwardly from its infeed end towards its discharge end so that the weight of the flight bar units 32 and the trays T maintain the pressure of the heaters on the flight bars pressing the film F against the side walls of the tray. It will be appreciated that the greater the angle in inclination, the greater the pressure. Typically, the angle of inclination is selected to give a pressure of about 1–3 psi.

The feed conveyor 70 thus serves to push all of the flight bar units 32 carried in the compression slot segments 40 through the machine with variations in tray length being automatically accommodated since the flight bar units 32 are free to shift with respect to each other. This allows multiple trays T to be placed in compression at any one time so that the necessary welding time can be achieved while at the same maintaining a high production rate. As the flight bar units 32 are pushed along the compression slot segments 40, the cutter cams 65 and 66 engage the cam followers 68 and 69 to cut the film between the trays T after it has been welded thereto in known manner so that the film covered trays are separated from each other for discharge from the machine 12.

Figure 4:
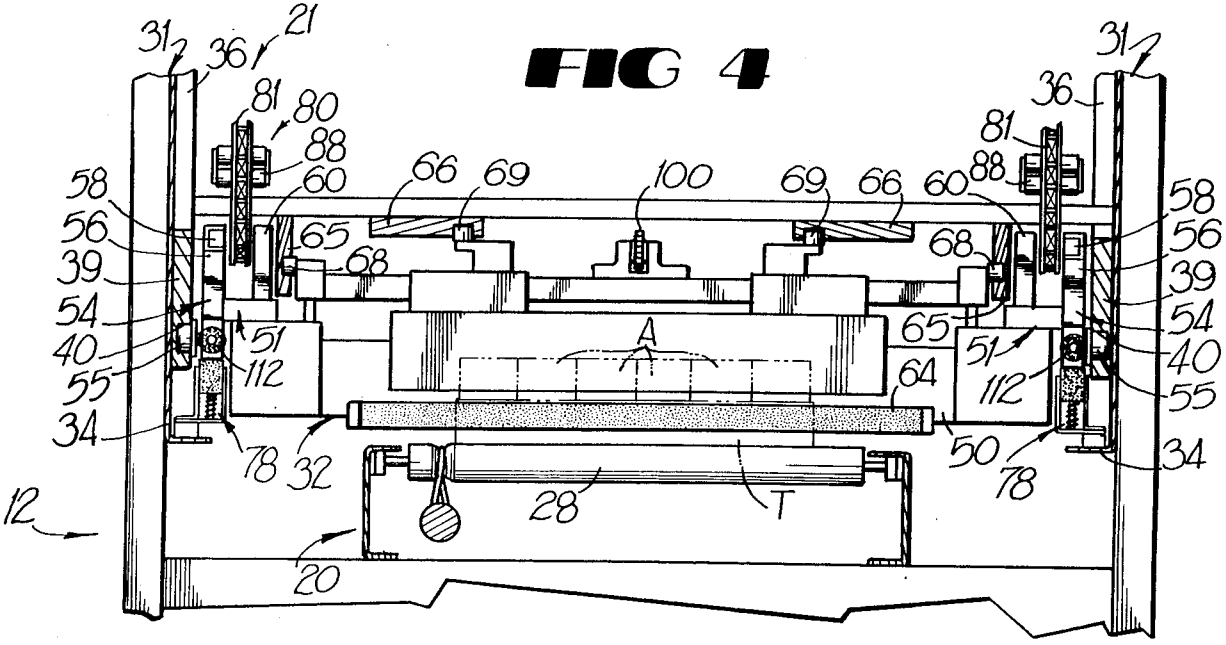
FIG. 4 is an enlarged transverse cross-sectional view taken generally along line 4—4 in FIG. 2.

To keep the leading flight bar unit 32 in the lower flight of the endless path from being inadvertently pushed away from the leading side wall on the tray, a pair of brakes 78 seen in FIGS. 2 and 4 are provided adjacent the discharge end of the machine to frictionally engage the mounting assemblies 51 so that the leading flight bar unit 32 must be positively forced thereover. This prevents the leading flight bar unit 32 from being inadvertently pushed away from the leading tray T in compression.

To move the flight bar units 32 along the riser slot segments 42 and onto the angled return slot segments 44, a lift conveyor 80 is provided which engages each flight bar unit 32 at the discharge end of the lower compression flight of the endless path and individually moves the flight bar unit 32 up along the riser slot segments 42. Lift conveyor 80 includes a pair of endless lift chains 81 trained around a lower idler sprocket 82 centered on the center of curvature of the lower end of the riser slot segments 42, a drive sprocket 84 on drive shaft 83 centered on the center of curvature of the upper end of the riser slot segments 42 and an idler sprocket 85. The lift chains 81 are located at the discharge ends of the lower flight of the endless path by keepers 86. Each of the lift chains 81 is provided with roller drive lugs 88 at spaced apart positions along the length of the chains 81. The drive lugs 88 are adapted to move in behind the leadingmost flight bar unit 32 in the lower compression flight of the endless path as it is pushed out of the position seen in FIG. 2 by the feed conveyor 70.

The lift chains 81 are located in vertical planes so that they are aligned with the space between the drive portion 56 on the mounting plate 54 and the drive plate 60 in each of the mounting assemblies 51 of the flight bar units 32. The roller drive lugs 88 project outwardly on opposite sides of the lift chains 81 so as to engage the trailing edges of the drive portion 56 and the drive plate 60 in the flight bar units 32. The lift conveyor 80 is activated by an appropriate switch engaged by the leadingmost flight bar unit 32 as it is pushed away from the position seen in FIG. 2 so that the drive lugs 88 move in behind the mounting assemblies 51 and push the flight bar unit 32 around the curved portion of the riser slot segments 42 and up the vertical portion of the riser slot segments 42. The lift conveyor 80 is cycled so that the flight bar unit 32 is moved up out of the way of the tray T with the film welded thereto so it can be discharged out of the machine on the live rollers 26 at the discharge end of machine 12. The spacing between the roller drive lugs 88 is such that, when the flight bar unit is moved into position as seen in FIG. 2, the next set of roller drive lugs 88 will not interfer with the movement of the next flight bar unit 32 being moved into the leadingmost position in the lower compression flight of the endless path. Preferably, the spacing between the roller drive lugs 88 on the lift chains 81 is slightly greater than the spacing between the roller drive lugs 76 on the feed chains 71 so that the lift chains 81 move slightly faster than the feed chains 71 and prevent interference between the flight bar units 32 and the dicharging trays. After the roller drive lugs 88 on the lift chains 81 have moved the flight bar unit 32 up the riser slot segments 42, the flight bar units 32 move onto the donwwardly angled return slot segments 44 which allow the flight bar units 32 to roll away from the drive lugs 88 under the influence of gravity.

Figure 5:
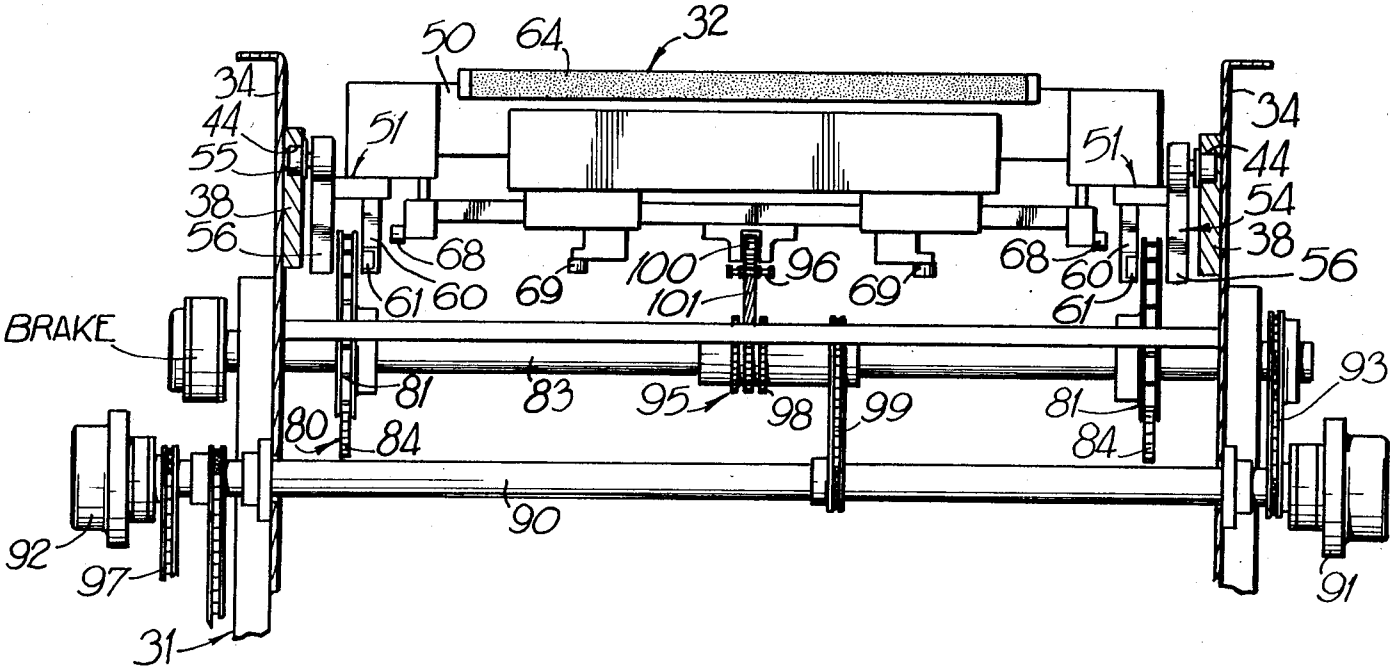
FIG. 5 is an enlarged transverse cross-sectional view taken generally along line 5—5 in FIG. 2.
Figure 6:
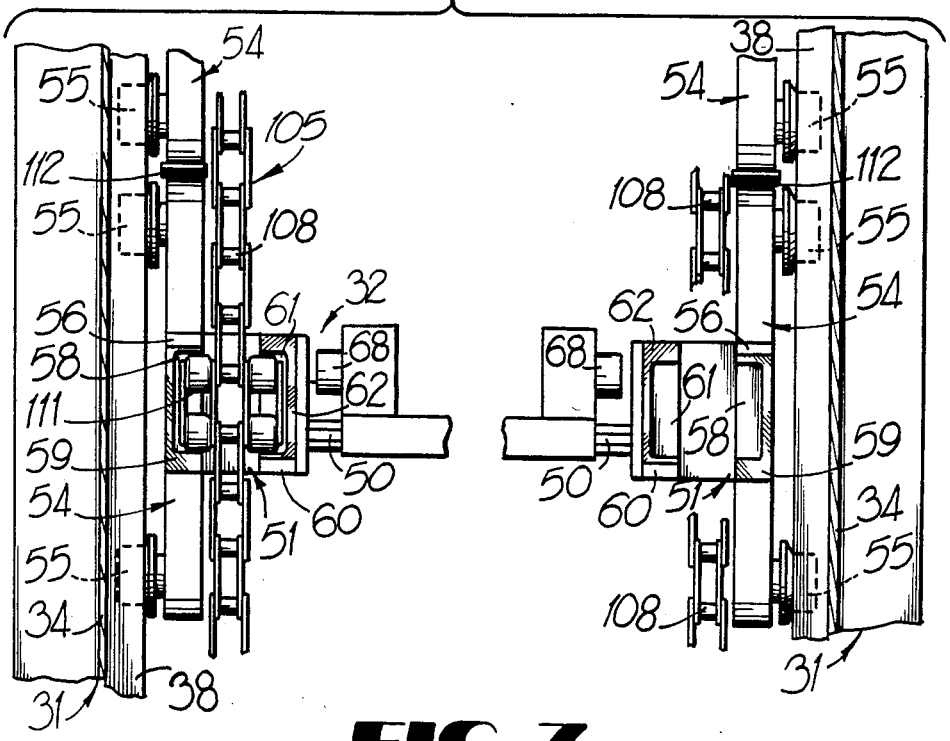
FIG. 6 is an enlarged cross-sectional view taken generally along line 6—6 in FIG. 2.

The feed chains 71 and life chains 81 are driven from a jack shaft 90 continuously driven by the drive unit 22 through drive chain 87 seen in FIG. 1. The drive shaft 83 of the lift conveyor 80 is driven from shaft 90 through a clutch 91 and drive chain 93 seen in FIG. 5 while the drive shaft 73 of the feed conveyor 70 is independently driven from the jack shaft 90 through clutch 92 and drive chain 97 so that the feed conveyor 70 and the lift conveyor 80 can be independently controlled. The drive shafts 73 and 83 are also provided with brakes (one of which is seen in FIG. 5) that are engaged when the shafts are disconnected from the jack shaft 90.

To prevent the flight bar units 32 from accellerating too fast away from the lift conveyor 80, a holdback conveyor 95 is provided. The holdback conveyor 95 includes an endless chain 96 trained around sprockets 98, one of which is rotatably mounted around shaft 83 in the lift conveyor 80 and the other sprocket 98 being rotatably mounted around shaft 73 in the feed conveyor 70. Thus, the endless chain 96 can be rotated independently of the rotation of the lift conveyor 80 and the feed conveyor 70. One of the sprockets 98 is connected to the jack shaft 90 through a chain and sprocket arrangement 99 (see FIG. 5) so that the upper flight of the endless chain 96 moves from the discharge end toward the infeed end of the machine at a prescribed speed. Each of the flight bar units 32 is provided with a clutch sprocket unit 100 which allows the sprocket thereon to rotate in only one direction. The upper end of the upper flight of the endless chain 96 is provided with a keeper 101 which raises the endless chain 96 to a position so that the sprocket on the clutch sprocket unit 100 engages the endless chain 96 as the flight bar unit 32 moves down the return slot segments 44. The permitted direction of rotation of the sprocket in the clutch sprocket unit 100 is selected so that the flight bar unit 32 cannot move down the return slot segments 44 faster than the endless chain 96 is moving. On the other hand, the chain 96 is free to move toward the infeed end of the machine faster than the flight bar unit 32 is moving as will become more apparent. The endless chain 96 is illustrated as a triple chain to insure that the sprocket in the clutch sprocket unit 100 will always engage the chain 96.

It will be appreciated that it is necessary to feed the flight bar units 32 to the feed conveyor 70 with a prescribed spacing therebetween so that the drive lugs 76 on the feed chains 71 can engage the mounting assemblies 51 in the recesses 58 and 61. To provide this function, a metering conveyor 105 is provided under the return slot segments 44 adjacent the feed conveyor 70 to leave an accumulating space 108 between the metering conveyor 105 and the lift conveyor 80. The metering conveyor 105 includes a pair of metering chains 108 on opposite sides of the machine trained around appropriate sprockets 109 which are driven from the drive shaft 73 in the feed conveyor 70 through a chain and sprocket arrangement 110 as seen in FIG. 1 so that the metering chains 108 are moved in a known relationship with respect to the feed chains 71. The metering chains 108 are provided with roller drive lugs 11 at spaced apart positions therealong that fit into the recesses 58 and 61 in the mounting assemblies 51 since the metering chains 108 are also arranged to pass within the space between the drive plate 60 and the drive portion 56 on the mounting plate 54 on the mounting assemblies 51. It will be appreciated that a sufficient number of flight bar units 32 will be used to insure that one of the flight bar units 32 will always be engaged by one set of the roller drive lugs 111 on the metering chains 108. The flight bar units 32 engaged by the drive lugs 111 on the metering chains 108 allow the flight bar units 32 moving down from the lift conveyor 80 to abut against each other in an end-to-end fashion in the accumulating space 106. Appropriate bumpers 112 are provided at the leading or trailing ends of the mounting plates 54 adjacent the rollers 55 to allow the mounting assemblies 51 to abut each other without damage thereto. Since the flight bar units 32 are abutting each other as they pass out of the accumulating space 106 onto the metering conveyor 105, it will be appreciated that the roller drive lugs 111 on the metering chains 108 will be spaced apart a distance equal to the center-to-center distance of the abutting flight bar units 32 while the spacing between the roller drive lugs 76 on the feed chains 71 on the feed conveyor 70 are spaced apart at a greater distance determined by the maximum tray width. For instance, the center-to-center spacing between the roller drive lugs 111 on the metering chains 108 illustrated is about 11 inches while the spacing between the roller drive lugs 76 on the feed chain 71 is about 18 inches. The metering chains 108 are moved at a speed such that the metering chains 108 move a distance equal to the spacing between the roller drive lugs 111 while the feed chains 71 move a distance equal to the spacing between the roller drive lugs 76.

Figure 7:
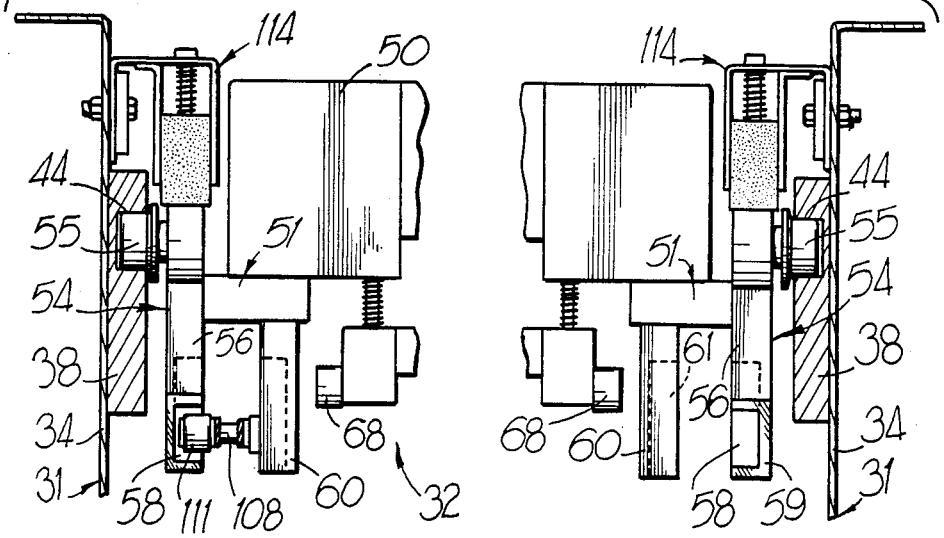
FIG. 7 is an enlarged transverse cross-sectional view taken generally along line 7—7 in FIG. 2.

To affect transfer between the metering conveyor 105 and the feed conveyor 70, a pair of sliding brakes 114 as seen in FIGS. 2 and 7 are provided on opposite sides of the machine so that they frictionally engage the edge of the mounting plate 54 in each of the mounting assemblies 51 while each flight bar unit 32 moves between the metering conveyor 105 and the feed conveyor 70. This requires that each flight bar unit 32 be pushed across the space between the metering conveyor 105 and the feed conveyor 70 by the flight bar unit 32 immediately trailing that flight bar unit between the two conveyors. The next trailing flight bar unit carried by the metering conveyor 105 pushes the flight bar unit 32 across the space between the metering conveyor 105 and the feed conveyor 70 so that the pushed flight bar unit 32 will lie in registration with the roller drive lugs 76 on the feed chains 71 as they pass over the drive sprockets 72. Thus, synchronization between the metering conveyor 105 and the feed conveyor 70 is positively assured. It will be appreciated that the offsets 45 in the return slot segments 44 are positioned so that each flight bar unit 32 is tilted as it passes thereover and in alignment with the roller drive lugs 76 on the feed chains 71 to facilitate the feeding of the roller drive lugs 76 on the feed chains 71 into the recesses 58 and 61 in the mounting assemblies 51. This also moves the flight bar unit 32 away from the brakes 114 so that the flight bar unit 32 is free to move with the feed chains 71.

In operation, it will be seen that each loaded tray T moving into the machine on the infeed conveyor 11 activates the feed conveyor 70 so that one of the flight bar units 32 is fed in behind the incoming tray T while at the same time folding the film F over the top of the articles in the tray. By the time this incoming flight bar unit 32 has reached a position behind the trailingmost tray T in the trays under compression, the flight bar unit 32 immediately preceeding this flight bar unit will be released so that a plurality of the flight bar units (here shown as five units so that four of the trays T are in compression at any one time) are released so that the flight bar units 32 in the compression flight of the endless path are interconnected to each other through the trays themselves so that all of the trays T are placed under compression.

As each new flight bar unit 32 is moved into the lower compression flight of the endless path, the leadingmost flight bar unit therein is displaced until it is engaged by the lift conveyor 80 to start being raised along the generally vertical riser flight of the endless path. As the lift conveyor keeps incrementally moving the flight bars 32 along the riser portion of the endless path, the flight bar units 32 are individually discharged into the downwardly angled return portion of the endless path so that the flight bar units 32 individually move into an accumulating position where they are held back by the metering conveyor. The metering conveyor individually feeds the flight bar units 32 to the feed conveyor 70 synchronously with the movement of the drive lugs thereon so that the fed conveyor 70 appropriately engages each flight bar unit 32 and feeds the flight bar units 32 around to the lower compression flight of the endless path.

What is claimed as invention is:

1. A packaging machine for applying film over articles in a plurality of trays including:

a plurality of flight bar means for moving and drawing said film between said trays;

support means for movably supporting said flight bar means for movement independently of each other along a compression path to permit different spacing between said flight bars for different size trays, said compression path having infeed and discharge ends;

an endless feed conveyor at the infeed end of said compression path including driving members at spaced apart positions therealong with a prescribed spacing therebetween regardless of the tray size for engaging said flight bar means and individually feeding said flight bar means into the infeed end of said compression path so that a tray of articles will be located between adjacent flight bar means and moving said flight bar means a prescribed distance along said compression path to push all of the trays and said flight bar means on said compression path therealong;

return means for individually removing said flight bar means from the discharge end of said compression path and returning same toward said feed conveyor; and a metering conveyor receiving said flight bar means from said return means, said metering conveyor driven independently of said feed conveyor and synchronized with the movement of said feed conveyor to individually transfer said flight bar means to said feed conveyor with a spacing between said flight bar means corresponding to the spacing between said driving members on said feed conveyor so that said flight bar means are successively engaged by said driving members on said feed conveyor.

2. The packaging machine of claim 1 wherein said support means is oriented so that said compression path angles upwardly with respect to the horizontal from the infeed end to the discharge end.

3. The packaging machine of claim 1 wherein said return means moves each of said flight bar means away from the discharge end of said compression path faster than said feed conveyor moves each of said flight bar means toward the infeed end of said compression path.

4. The packaging machine of claim 1 wherein said metering conveyor is spaced from said feed conveyor and further including a frictional brake positioned between said metering conveyor and said infeed conveyor to frictionally engage said flight bar means as said flight bar means move from said metering conveyor to said conveyor so that said metering conveyor forcibly pushes said flight bar means past said brake to deliver said flight bar means to said feed conveyor with the spacing therebetween corresponding to the spacing between said driving members.

5. The packaging machine of claim 4 further including accumulating means between said return means and said metering conveyor for accumulating a plurality of said flight bar means received from said return means so that flight bar means are successively and individually engaged by said metering conveyor.

6. The packaging machine of claim 4 further including transfer means for transferring said flight bar means from said return means to said metering conveyor under the influence of gravity.

7. The packaging machine of claim 4 further including drive means for independently operating said feed conveyor said metering conveyor, said metering conveyor and said return means.

8. The packaging machine of claim 4 further including tray support means for supporting the trays while the trays are positioned between said flight bar means moving along said compression path.

9. A self-adjusting packaging machine for applying a film against opposed upstanding side walls of a plurality of trays, said machine comprising:

conveyor means for supporting the trays loaded with articles for movement along a prescribed product path;

dispensing means for disposing the film over the articles and the trays moving along the product path;

a plurality of flight bar units adapted to press the film over the articles against the opposed tray side walls;

track means for movably supporting said plurality of flight bar units separately from each other for free movement along an endless path so that the spacing between adjacent flight bar units can be independently changed, said endless path having a compression portion defining opposed infeed and discharge ends thereon where the trays on said conveyor means can be captivated between adjacent said flight bar units;

an endless feed conveyor including spaced apart driving members thereon for moving said flight bar units individually along a portion of said endless path with a first prescribed spacing therebetween and onto said compression portion of said endless path through the infeed end thereof to locate said flight bar units between adjacent trays on said conveyor means, said feed conveyor releasing said flight bar units on said compression portion of said endless path except the trailingmost of said flight bar units thereon so that the trays space said flight bar units apart on said compression portion of said endless path to automatically compensate for different size trays;

return means independent of said feed conveyor for individually moving said flight bar units along said endless path from the discharge end of the compression portion thereof back toward the infeed end thereof; and an endless metering conveyor for arresting the movement of said flight bar units abutting each other along said endless path and for individually moving said flight bar units to said fee conveyor synchronously with the movement of said driving members past said metering conveyor so that said driving members will engage and move said flight bar units to said compression portion of said endless path with said first prescribed spacing therebetween.

10. The packaging machine of claim 9 wherein said endless path further includes a return portion along which said flight bar means move as said flight bar means return from the discharge end to the infeed end of said compression portion, said return portion angling downwardly toward the infeed end of said compression portion of said endless path and further including holdback means for limiting the speed at which said flight bar units move down said return portion of said endless path toward said metering means under the influence of gravity.

11. The packaging machine of claim 9 wherein said feed conveyor includes a pair of spaced apart feed chains and a plurality of said driving members mounted on each of said feed chains at said first prescribed spacing therebetween, said driving members on said chains adapted to releasably engage said flight bar units at opposite ends thereof and move said flight bar units onto said compression portion of said endless path.

12. The packaging machine of claim 9 further including a frictional brake positioned adjacent said endless path between said feed conveyor and said metering conveyor for frictionally engaging each of said flight bar units moving along said track means between said metering conveyor and said feed conveyor so that each of said flight bar units will be pushed past said brake by a successive abutting flight bar unit engaged by said metering conveyor to deliver each of said flight bar units to said feed conveyor synchronously with the movement of said driving members thereby.

13. A packaging machine for applying film over articles in a plurality of trays including:

a plurality of flight bar means;

support means for movably supporting said flight bar means for movement independently of each other along a compression path having infeed and discharge ends;

a feed conveyor for individually forcing said flight bar means into the infeed end of said compression path;

a metering conveyor associated with and separate from said feed conveyor for receiving said flight bar means with a first spacing therebetween and individually delivering said flight bar means to said feed conveyor with a second spacing therebetween; and return means separate from said metering conveyor for individually removing said flight bar means from the discharge end of said compression path and returning same to said metering conveyor.

14. The packaging machine of claim 13 wherein said feed conveyor is spaced a prescribed distance from said metering conveyor and further including a friction brake positioned between said feed conveyor and said metering conveyor to frictionally engage said flight bar means moving from said metering conveyor to said feed conveyor so that each of said flight bar means engaged by said brake will be pushed thereby by a successive flight bar means engaged by said metering conveyor to deliver said flight bar means from said brake to said feed conveyor with said second spacing.

15. The packaging machine of claim 14 wherein said feed conveyor includes first endless flexible means movable along a prescribed feed path adjacent the infeed end of the compression path and a plurality of feed members mounted on said first endless flexible means at spaced apart positions therealong at said second spacing, said feed members adapted to releasably engage said flight bar means and force said flight bar means into the compression path as said endless flexible means is moved; and wherein said metering conveyor includes second endless flexible means movable along a prescribed feed path adjacent said feed conveyor and a plurality of meter members mounted on said second endless flexible means at spaced apart positions therealong at said first spacing, said flight bar means releasably engaged by said meter members on said metering conveyor while said flight bar means are at said first spacing abutting each other and said metering conveyor driven so as to cause said meter members to deliver said flight bar means to said feed members on said feed conveyor with said second spacing therebetween.

16. The packaging machine of claim 15 further including a friction brake between said feed conveyor and said metering conveyor, said friction brake including at least one brake member and means for resiliently urging said brake member into friction contact with each of said flight bar means while said flight bar means moves from said metering conveyor to said feed conveyor to cause said flight bar means being held to move toward said feed conveyor only while being pushed by said metering conveyor through successive flight bar means engaged by said meter members to deliver said flight bar means to said feed conveyor synchronously with the movement of said feed members on said feed conveyor.

* * * * *